US005651343A

United States Patent [19]

Evans et al.

[11] Patent Number: 5,651,343

[45] Date of Patent: Jul. 29, 1997

[54] IDLE SPEED CONTROLLER

[75] Inventors: David Scott Evans, deceased, late of South Lyon, by Sarah G. Evans, administrator; Edward Albert Bos; Simon Warran-Smith, both of Ann Arbor, all of Mich.

[73] Assignee: Ford Motor Company, Dearborn, Mich.

[21] Appl. No.: 554,057

[22] Filed: Nov. 6, 1995

[51] Int. Cl.[6] ..... F02D 11/10; F02D 41/16

[52] U.S. Cl. ..... 123/339.26; 123/336; 123/361

[58] Field of Search ..... 123/339.25, 339.26, 123/361, 399, 336

[56] References Cited

U.S. PATENT DOCUMENTS

| | | | |
|---|---|---|---|
| 4,367,708 | 1/1983 | Nakamura et al. | 123/361 |
| 4,526,060 | 7/1985 | Watanabe | 74/626 |
| 4,541,378 | 9/1985 | Kitamura | 123/399 X |
| 4,569,321 | 2/1986 | Bonfiglioli et al. | 123/438 |
| 4,850,318 | 7/1989 | Torigai et al. | 123/352 |

FOREIGN PATENT DOCUMENTS

| | | |
|---|---|---|
| 57-193735 | 11/1982 | Japan . |
| 1330363 | 7/1971 | United Kingdom . |
| 2068456 | 1/1981 | United Kingdom . |
| 2233039 | 2/1991 | United Kingdom . |

*Primary Examiner*—Tony M. Argenbright
*Attorney, Agent, or Firm*—Donald A. Wilkinson

[57] ABSTRACT

A throttle body for use in the air intake system of an internal combustion engine having an idle speed control. The throttle body assembly (10) includes a throttle plate (18) mounted to a throttle shaft (16), which is, in turn, mounted to a throttle control lever (20). A bearing member (30) is coupled to the throttle control lever (20). A motor (32) is mounted relative to the throttle body and includes an idle control cam (36) mounted to the motor shaft (34) so that the bearing (30) rests on the cam (36). A circuit (40) actuates the motor (32). This arrangement provides a variable idle stop for the throttle plate (18) where the cam (36) is directly controlled by the motor (32). The motor size is minimized by providing an overdrive function that overdrives the motor (32) during transitional phases, to obtain fast response time and high resolution of idle control. Further, this idle stop does not interfere with the smooth operation of the accelerator cable (24) during engine operating conditions other than idle.

14 Claims, 2 Drawing Sheets

IDLE SPEED CONTROLLER

FIELD OF THE INVENTION

The present invention relates to throttle bodies and port throttles employed in the air induction system of an internal combustion engine and more particularly to the control of the throttle vane within the throttle body during engine idle conditions.

BACKGROUND OF THE INVENTION

Generally, throttle bodies restrict the amount of air inducted into an internal combustion engine, based on input from various factors such as accelerator pedal position, thus controlling the engine output. A valve, commonly a butterfly valve, is typically employed to control the amount of air flow. At idle, the valve is closed and air can only flow either through a bypass valve, if so equipped, or through small openings left around the valve for this purpose. Under certain engine idle conditions, more air flow through the throttle body is needed in order to increase the idle speed to allow for smooth, stable idle. Some examples of such conditions are starting and running when the engine is cold, and when running heavy load auxiliary equipment, such as vehicle air conditioning.

Many prior art designs use an air by-pass solenoid valve mounted in a separate bore that bypasses the throttle plate. However, this design can cost more than is desirable and creates a possible air leak path through the bypass valve, making the amount of air flow difficult to accurately calibrate, particularly for small capacity engines, (e.g., less than one liter in displacement). With the bypass tube, the solenoid valve cannot independently determine its position without a separate position sensor, thus further raising the likelihood of inaccuracies in the system.

Other prior art designs modulate the throttle valve itself to control idle air flow in order to avoid the use of a bypass valve. However, they typically employ a gear train, used to maximize throttle valve position resolution, and a linear motor that operates the throttle valve via a push rod. This gear train helps to allow for adequate motor torque build-up, without requiring an excessively large motor to drive the system adequately, and helps to overcome the inherent limitation on a typical motor that the running torque is less than the holding torque. Nevertheless, the gear train slows down the response time and can be relatively complex and expensive, with several failure modes possible. This is the trade off of mechanical advantage versus response time, (motor size versus gearing).

Further, it is desirable that the idle control assembly have a failure mode which drops the throttle plate back to low idle if the motor fails, rather than being stuck where it is if the motor fails at high idle. Also, preferably, an idle control system is employed that will not restrict the smooth movement of the accelerator pedal at off-idle conditions and will allow for a linearized increase in air flow in order to aid in engine calibration.

Therefore, it is desirable to have a simple, thus inexpensive and likely more reliable, design that still has a fast response time and high resolution with minimal power use, while still minimizing the size of the components within the assembly. The same desire is also true of a port throttle design wherein each intake port includes its own air control valve, as opposed to a design with just one air control valve in a single throttle body.

SUMMARY OF THE INVENTION

In its embodiments, the present invention contemplates a throttle having an idle speed controller for use in the air intake system of an internal combustion engine. The throttle comprises a throttle housing having a main bore and a throttle shaft mounted within the main bore. A throttle plate is mounted to the throttle shaft within the main bore and rotatable relative to the main bore by rotating the throttle shaft between a closed position and various partially open positions. A throttle control lever is mounted to the throttle shaft and includes a bearing portion protruding therefrom, and a throttle spring is mounted between the throttle housing and the throttle control lever, biasing the throttle plate toward the closed position. Accelerator means, operatively engage the throttle control lever, biasing the throttle plate toward one of its open positions, against the bias of the throttle spring, when actuated. Further, an actuator is positioned relative to the housing, including a motor and an actuator shaft protruding therefrom that is rotatable by the motor, and a cam member is mounted directly to the actuator shaft, with the motor positioned such that the bearing portion of the throttle control lever will come into surface contact with the cam member when the accelerator means is not biasing the throttle plate toward one of its open positions. The throttle further includes control means, connected to the motor, for causing the motor to rotate the actuator shaft.

Accordingly, an object of the present invention is to provide an idle speed controller that will directly modulate the throttle valve (or valves) to account for various desired engine idle conditions without requiring a gear train to operate, having a fast response time and high resolution.

An advantage of the present invention is a cost reduction over prior art systems while still being accurate.

A further advantage of the present invention is that it imparts no restriction on smooth accelerator pedal travel, and allows for a failure mode that will allow the assembly to revert to a low idle condition should the idle control motor fail when at a high idle.

Another advantage of the present invention is that the size of the motor used to direct drive the idle control cam can be minimized by operating the motor with an overdrive strategy during fast transitions in idle speed.

A still further advantage of the present invention is the use of the idle control assembly to control port throttles associated with individual cylinders for engines that control the air flow into individual cylinders.

An additional advantage to the present invention is that the cam profile can be chosen to linearize the airflow versus the cam angle in order to aid engine calibration.

DETAILED DESCRIPTION OF THE PREFERRED EMBODIMENTS

Figure 1:
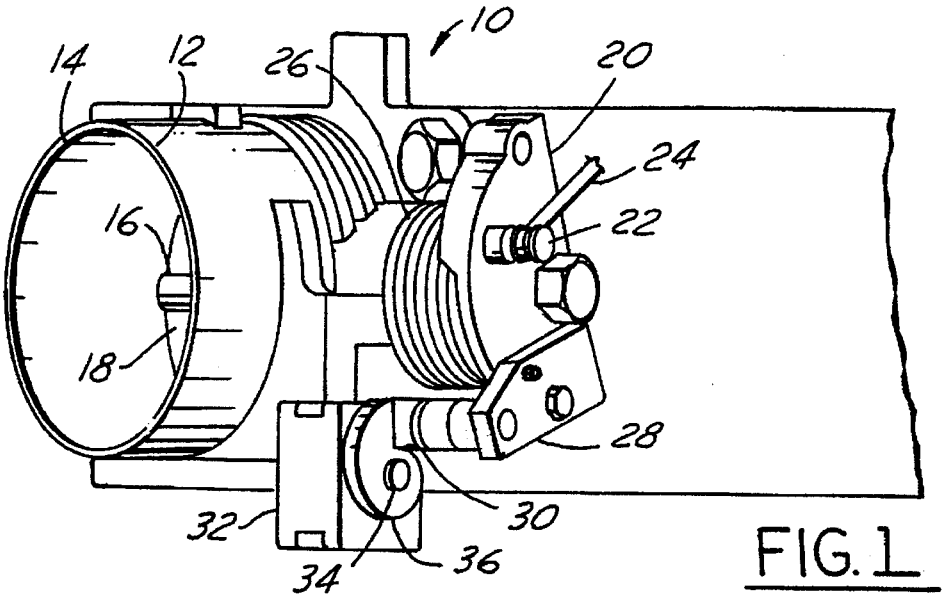
FIG. 1 is a general perspective view of a throttle body in accordance with the present invention.
Figure 2:
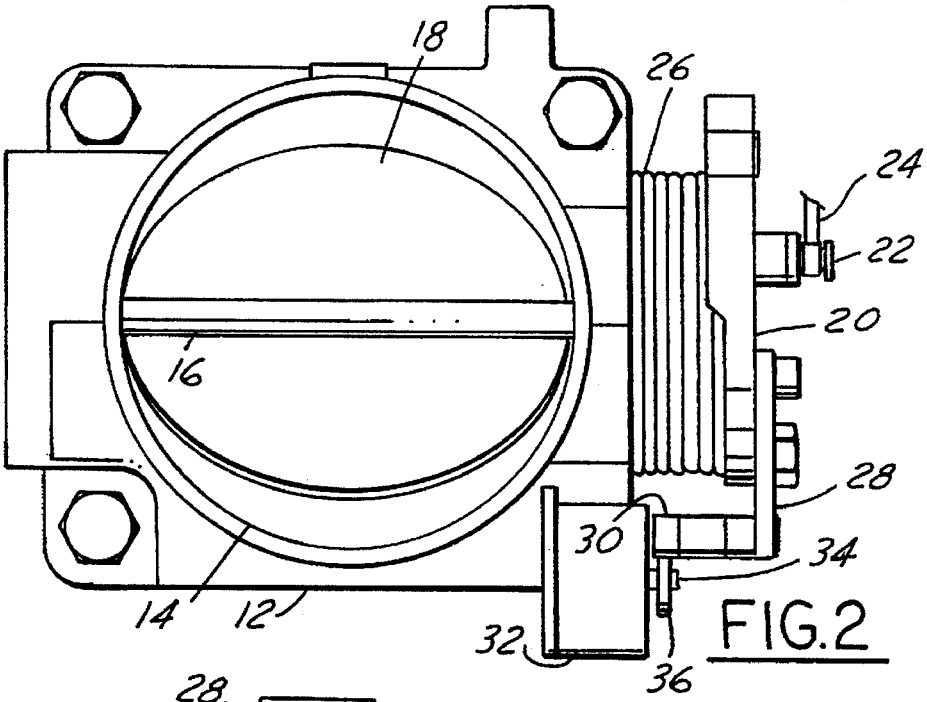
FIG. 2 is a side view, on an enlarged scale, of the throttle body of FIG. 1.
Figure 3:
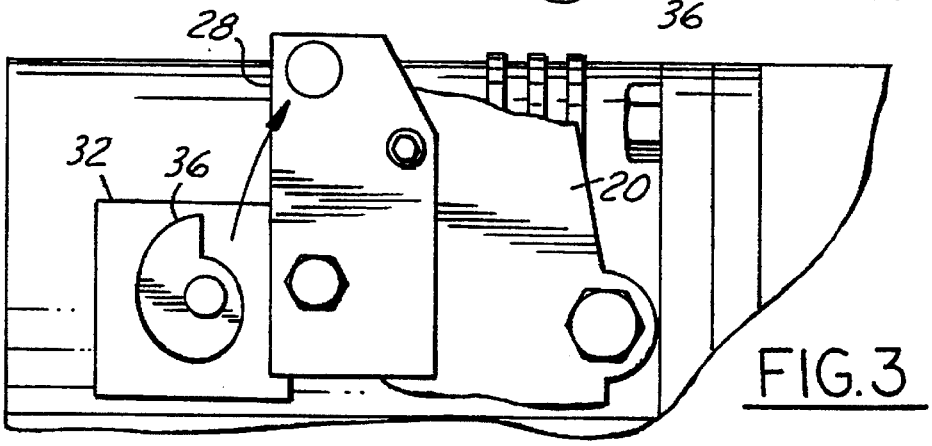
FIG. 3 is another side view, on an enlarged scale, of the throttle body of FIG. 1.

A throttle body assembly 10 includes a throttle body housing 12 having a generally cylindrical main bore 14 therethrough. Rotatably mounted in and generally perpendicular to the bore 14 is a throttle shaft 16. A throttle plate 18 is mounted to the throttle shaft 16 such that rotation of the shaft 16 in one direction will cause the throttle plate 18 to rotate toward a closed position where air flow is substantially blocked through the entire bore 14, and rotation of the shaft 16 in the other direction will gradually increase the opening in the bore 14 through which air can flow up to a full open position where an edge of the throttle plate 18 faces upstream in the bore 14.

The throttle shaft 16 protrudes out through the housing 12 and is fastened to a throttle control lever 20. The throttle control lever 20 includes a pin 22 protruding therefrom generally parallel with the throttle shaft 16 and offset from the throttle shaft center line. An accelerator cable 24 is connected to the pin 22 and, in turn, is coupled to the vehicle accelerator pedal, not shown, in a conventional fashion. By actuating the accelerator cable 24, the throttle plate 18 is caused to rotate. A throttle spring 26 is mounted between the throttle control lever 20 and the housing 12, biasing the rotation of the throttle plate 18 toward its closed position.

An idle position lever 28 is fastened to the throttle control lever 20 and includes a bearing member 30 protruding therefrom in a direction generally parallel with the throttle shaft 16. An actuator, including a motor 32, is mounted to the throttle body housing 12. The motor 32 is preferably a stepper motor, although other types of motors can be used. The stepper motor 32 moves to known positions. An advantage in using a stepper motor is that back EMF position sensing can be used. It has coarse position sensing that is accomplished without an external position encoder.

The motor 32 includes an actuator shaft 34 protruding therefrom that is oriented generally parallel to the throttle shaft 16. On the actuator shaft 34 is mounted an idle control cam 36. The idle control cam 36 aligns with the bearing member 30 such that when the accelerator cable 24 is not actuated, the throttle spring 26 will bias the throttle control lever 20 in a direction that causes the bearing member 30 to be in surface contact with the idle control cam 36. The cam is shaped such that the radius gradually increases around the cam to a maximum and then steps back down to the beginning minimum radius.

Figure 4:
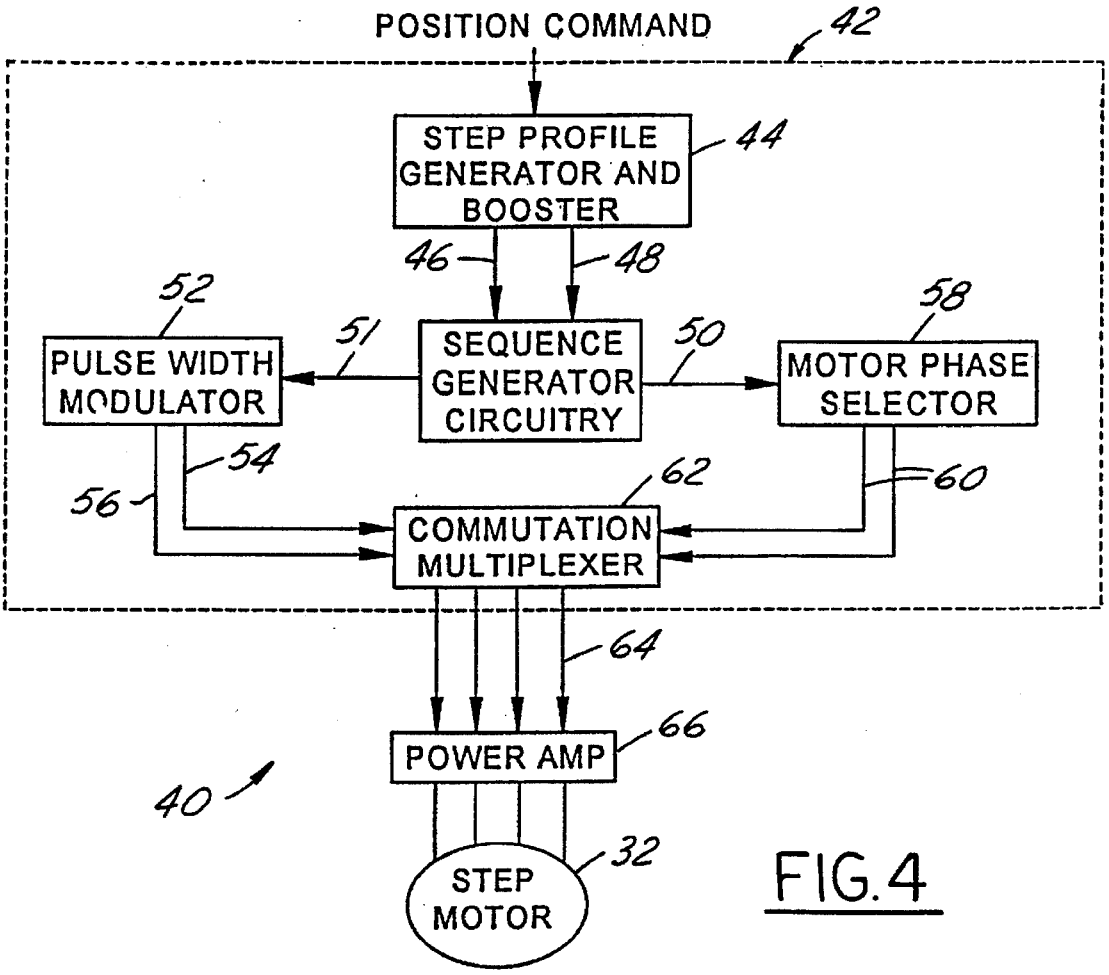
FIG. 4 is a schematic diagram of an electronic circuit for controlling the motor in the idle speed controller.

FIG. 4 illustrates a schematic diagram of an electronic circuit 40 for controlling the motor 32. The circuit includes a main functional portion 42 that may take the form of hardware (combination logic) or software within a microprocessor. The main functional portion 42 includes a step profile generator and booster 44, which receives a position command signal from an engine control unit, not shown. The step profile generator and booster 44 can send a reset signal 46 to reset the motor 32 to its home position, and also sends a trigger signal 48, which issues pulses at various rates to control the speed at which position commands are sent to the motor 32. By controlling the motor in this way, optimum response times are achieved.

A sequence generation circuit 50 reads the pulses of reset signal 46 and trigger signal 48 and sends a signal 51 to a pulse width modulator (PWM) 52, which has PWM output number one 54 and PWM output number two 56. The circuit 50 determines when to update the PWM 52 outputs and when to update how the PWM signals 54 and 56 are routed. The PWM 52 emits output signals one and two 54 and 56 on the order of 10 KHz to perhaps 500 KHz and are fed into a commutation multiplexer 62. The duty cycle resolution dictates the precision with which the motor 32 may be micro-stepped.

The sequence generation circuit 50 also sends a signal 57 to a motor phase selector 58. The motor phase selector 58 decides which phases of the motor 32 should get the current PWM commands. A signal 60 is sent from the motor phase selector 58 to the commutation multiplexer 62. The PWM commands control the amount of current delivered to the motor phases, hence the ability to micro-step the motor 32 by routing signals appropriately.

The commutation multiplexer 62 contains the logic to route the two PWM signals 54 and 56 out of the electronic circuit 40 to three or four motor phases 64 (shown as four herein). The four motor phases 64 are fed into a power amp 66, which, in turn, feeds into and actuates the motor 32. As can be seen in FIG. 1, the motor drives the cam 36, controlling the amount of idle stop.

If the PWM 52 has the capacity to emit 3 to 4 distinct signals, then the motor phase selector 58, the sequence generation circuit 50 and the communication multiplexer 62 can be removed and the PWM 52 can be fed directly from the step profile generator and booster 44, and, in turn, directly feed the power amp 66.

Since for a typical motor, the motor running torque is less than the holding torque, it is not obvious how to direct drive the cam 36 with sufficient speed. To overcome this, the motor 32 is overdriven during large transitions to allow for a smaller motor to be used, since it is only overdriven for a short period of time. The controller hierarchy is designed to do this. During the large transitions, extra power is dumped to run the motor 32 at higher than it is rated (i.e., surged above motor rating for continuous duty operation), but kept to a short period of time, so the motor will not overheat.

The orientation of the cam 36 determines the minimum opening of the throttle plate 18 within the main bore 14. If the cam 36 is rotated such that the smallest diameter of the cam 36 is in surface contact with the bearing member 30, then the throttle plate 18 is almost completely closed, only allowing a very small amount of air to pass through the main bore 14. As the cam 36 rotates to an orientation where a larger diameter portion of the cam is in contact with the bearing member 30, then the idle position of the throttle plate 18 is changed so that progressively more air is allowed to flow through the main bore 14. Preferably, the cam 36 is sized to allow for a maximum idle opening of ten percent of the throttle plate 18 motion from its closed position, although for different engines, this amount may vary.

Thus, in effect, this arrangement acts as a variable idle stop, limiting how far the throttle plate 18 can close, so that it limits the minimum idle air that can pass through the valve. Under operating conditions where the accelerator cable is activated, the bearing 30 is not in surface contact with the idle control cam 36 and the orientation of the cam 36 has no effect. This condition occurs, for instance, when there is torque demand from the vehicle driver. Only when the accelerator cable is not activated, and thus the bearing 30 is in contact with the cam 36 does the orientation of the cam matter. It then defines various open positions of the throttle when the accelerator cable 24 is not actuated. Further, if the motor fails while in a higher idle state, the bearing 30, being biased against the cam 36, will cause the cam 36 to rotate toward its smaller diameter portion, thus allowing the idle to be at a minimum level.

This cam arrangement can control the throttle valve movement with a resolution on the order of 1/100's of a degree. The motor/cam design provides for very high resolution of valve movement at idle, allowing a smaller motor to be used.

Activation of the accelerator cable 24 can also include an automatic speed control mechanism, whether it actually activates the accelerator cable or in some other way rotates the throttle plate 18 into some degree of open position, in that, when the throttle shaft is rotated into other than an idle condition, the throttle control lever will also rotate with the shaft, thus lifting the bearing 30 off of the idle control cam 36.

Figure 5:
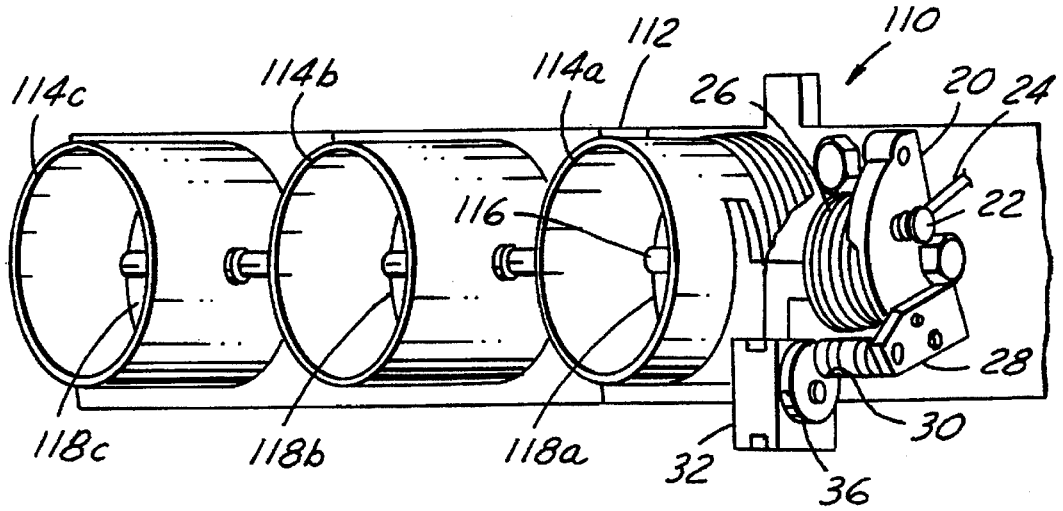
FIG. 5 is a general perspective view of a port throttle arrangement in accordance with an alternate embodiment of the present invention.

An alternate embodiment of the present invention is illustrated in FIG. 5, where this direct drive idle control system is used in the air intake system of an engine employing port throttle control, controlling the air flow into individual cylinders with individual throttle plates. In this embodiment, like elements with the first embodiment have like numbers and the elements that have changed are given 100-series numbering.

The throttle body 110 includes a throttle housing 112 that has three bores in parallel; a first main bore 114*a*, a second main bore 114*b* and a third main bore 114*c*. The throttle shaft 116 extends through all of the bores 114*a*, 114*b*, and 114*c*. One of three throttle plates 118*a*, 118*b* and 118*c* are mounted to the shaft 116 in each of the corresponding bores. The throttle shaft 116 is coupled to the motor 32 as in the first embodiment. The motor and cam mechanism and electronics remain essentially unchanged. The port throttles, then, act as individual throttle bodies for each cylinder. In this way, high resolution idle control can be maintained while still having the advantages of individual port control of air intake. One of the benefits to adapting this invention to the port throttle design is the ability to use a smaller motor because the amount of movement required from the cam to change the amount of air flow is less, improving the mechanical advantage of the system.

While certain embodiments of the present invention have been described in detail, those familiar with the art to which this invention relates will recognize various alternative designs and embodiments for practicing the invention as defined by the following claims.

We claim:

1. A throttle assembly having an idle speed controller for use in the air intake system of an internal combustion engine comprising:

a throttle housing having a main bore;

a throttle shaft mounted within the main bore;

a throttle plate mounted to the throttle shaft within the main bore and rotatable relative to the main bore by rotating the throttle shaft between a closed position and various partially open positions;

a throttle control lever mounted to the throttle shaft including a bearing portion protruding therefrom;

a throttle spring coupled between the throttle housing and the throttle control lever, biasing the throttle plate toward the closed position;

accelerator means, operatively engaging the throttle control lever, for biasing the throttle plate toward one of its open positions, against the bias of the throttle spring, when actuated;

an actuator positioned relative to the housing, including a motor and an actuator shaft protruding therefrom that is rotatable by the motor and a cam member mounted directly to the actuator shaft, the motor positioned such that the bearing portion of the throttle control lever will come into surface contact with the cam member when the accelerator means is not biasing the throttle plate toward one of its open positions; and control means, connected to the motor, for causing the motor to rotate the actuator shaft.

2. The throttle assembly of claim 1 wherein the throttle housing is a throttle body housing and includes a second main bore adjacent and parallel to the main bore, and the throttle shaft is mounted within each of the main bores and a second throttle plate is mounted to the throttle shaft within the second main bore and rotatable relative to the second main bore by rotating the throttle shaft.

3. The throttle assembly of claim 1 wherein the throttle housing is a port throttle housing and includes a second and a third main bore adjacent and parallel to the main bore, and the throttle shaft is mounted within each of the main bores, and a second throttle plate is mounted to the throttle shaft within the second main bore and a third throttle plate is mounted to the throttle shaft within the third main bore, with each throttle plate rotatable relative to its respective main bore by rotating the throttle shaft.

4. The throttle assembly of claim 1 wherein the cam member is sized so that the smallest diameter of the cam member will allow the throttle plate to reach the closed position when the bearing portion rests on the cam member and the largest diameter of the cam member will allow the throttle plate to close to about ten percent of the fully closed position when the bearing portion rests on the cam member.

5. The throttle assembly of claim 1 wherein the motor has a rated capacity and the motor can be actuated by the control means to operate at over capacity when actuating the cam member and hold the cam member in position without being over the capacity rating.

6. The throttle assembly of claim 1 wherein the motor is a stepper motor.

7. The throttle assembly of claim 6 wherein the control means comprises:

a step profile generator and booster adapted for receiving a position command signal;

a pulse width modulator electrically connected to receive signals from the step profile generator and booster; and a power amp electrically connected to receive signals from the pulse width modulator and actuate the motor.

8. The throttle assembly of claim 7 wherein the control means further comprises:

a sequence generation circuit electrically connected between the step profile generator and booster and the pulse width modulator;

a motor phase selector electrically connected to receive signals from the sequence generation circuit; and a commutation multiplexer electrically connected between the pulse width modulator and the power amp that electrically receives signals from the motor phase selector.

9. The throttle assembly of claim 8 wherein the motor has a rated capacity and the motor can be actuated by the control means to operate at over capacity when actuating the cam member and hold the cam member in position without being over the capacity rating.

10. A throttle assembly having an idle speed controller for use in the air intake system of an internal combustion engine comprising:

a throttle housing having a main bore a throttle shaft mounted within the main bore;

a throttle plate mounted to the throttle shaft within the main bore and rotatable relative to the main bore by rotating the throttle shaft between a closed position and various partially open positions;

a throttle control lever mounted to the throttle shaft including a bearing portion protruding therefrom;

a throttle spring coupled between the throttle housing and the throttle control lever, biasing the throttle plate toward the closed position;

accelerator means, operatively engaging the throttle control lever, for biasing the throttle plate toward one of its open positions, against the bias of the throttle spring, when actuated;

an actuator positioned relative to the housing, including a stepper motor and an actuator shaft protruding therefrom that is rotatable by the motor and a cam member mounted directly to the actuator shaft, with the motor positioned such that the bearing portion of the throttle control lever will come into surface contact with the cam member when the accelerator means is not biasing the throttle plate toward one of its open positions; and control means, connected to the motor, for causing the motor to rotate the actuator shaft, wherein the motor has a rated capacity and the motor can be actuated by the control means to operate at over capacity when actuating the cam member and hold the cam member in position without being over the capacity rating.

11. A method of operating a throttle assembly having an idle speed controller for use in an air intake system of an internal combustion engine comprising the steps of:

providing a throttle housing having a main bore;

providing a throttle shaft mounted within the main bore;

providing a throttle plate mounted to the throttle shaft within the main bore and rotatable relative to the main bore by rotating the throttle shaft between a closed position and various partially open positions;

providing a throttle control lever mounted to the throttle shaft including a bearing portion protruding therefrom;

providing a throttle spring coupled between the throttle housing and the throttle control lever, biasing the throttle plate toward the closed position;

providing accelerator means, operatively engaging the throttle control lever, for biasing the throttle plate toward one of its open positions, against the bias of the throttle spring, when actuated;

providing an actuator positioned relative to the housing, including a stepper motor and an actuator shaft protruding therefrom that is rotatable by the motor and a cam member mounted directly to the actuator shaft, the motor positioned such that the bearing portion of the throttle control lever will come into surface contact with the cam member when the accelerator means is not biasing the throttle plate toward one of its open positions;

providing control means, connected to the motor, for causing the motor to rotate the actuator shaft wherein the motor has a rated capacity;

actuating the motor by the control means to operate at over capacity when actuating the cam member; and holding the cam member in position without being over the motor capacity rating.

12. The method of claim 11 further comprising the steps of:

rotating the cam member to a position such that the cam member will allow the throttle plate to reach the closed position when the bearing portion rests on the cam member and rotating the cam member to a different position such that the cam member will allow the throttle plate to close to within ten percent of the fully closed position when the bearing portion rests on the cam member.

13. The method of claim 11 wherein the step of providing the control means comprises:

providing a step profile generator and booster adapted for receiving a position command signal;

providing a pulse width modulator electrically connected to receive signals from the step profile generator and booster; and providing a power amp electrically connected to receive signals from the communication multiplexer and actuate the motor.

14. The method of claim 11 further comprising, rotating the cam member to a position such that the cam member will allow the throttle plate to reach the closed position when the bearing member rests on the cam member if the motor fails.

* * * * *